US005504274A

United States Patent [19]

McCabe et al.

[11] Patent Number: 5,504,274

[45] Date of Patent: Apr. 2, 1996

[54] LIGHTWEIGHT BRAIDED SHIELDING FOR WIRING HARNESSES

[75] Inventors: Brian L. McCabe, Orange; Edward L. Kirchner, Stratford, both of Conn.

[73] Assignee: United Technologies Corporation, Hartford, Conn.

[21] Appl. No.: 309,295

[22] Filed: Sep. 20, 1994

[51] Int. Cl.[6] ..... H01B 7/34

[52] U.S. Cl. ..... 174/36; 87/8; 156/50; 156/51; 174/72 A; 174/109

[58] Field of Search ..... 174/36, 109, 117 M, 174/72 A; 139/425 R; 87/8; 156/50, 51

[56] References Cited

U.S. PATENT DOCUMENTS

| | | | |
|---|---|---|---|
| 4,547,626 | 10/1985 | Pedersen et al. | 174/107 |
| 4,719,319 | 1/1988 | Tighe, Jr. | 174/103 |
| 4,754,102 | 6/1988 | Dzurak | 174/36 |
| 5,012,045 | 4/1991 | Sato | 174/106 R |
| 5,115,105 | 5/1992 | Gallusser et al. | 174/36 |
| 5,254,188 | 10/1993 | Blew | 174/36 |
| 5,262,591 | 11/1993 | Aldissi | 174/36 |
| 5,313,020 | 5/1994 | Sackett | 174/113 C |
| 5,414,211 | 5/1995 | Chan | 174/36 |

FOREIGN PATENT DOCUMENTS

| | | | |
|---|---|---|---|
| 6-150731 | 5/1994 | Japan | 174/72 A |

*Primary Examiner*—Morris H. Nimmo
*Attorney, Agent, or Firm*—William W. Jones

[57] ABSTRACT

A lightweight braided metallic shielding is applied to wiring harnesses to protect against lightning strikes and electromagnetic interference (EMI). The braided shielding has an open braid construction which may be as much as 40% lighter in weight and which provides better electromagnetic shielding than conventional braided shielding. The decrease in weight is achieved by utilizing a braid carrier application angle, as measured from the axis of the wire harness, which is as small as about eighteen degrees, so as to produce a braided shield that has as few as four picks per inch. The ensuing braided shield is very flexible and results in a degree of wire harness coverage which may be as low as about 60%, but which exhibits low electrical resistance which contributes significantly to lightning protection and EMI shielding.

8 Claims, 1 Drawing Sheet

LIGHTWEIGHT BRAIDED SHIELDING FOR WIRING HARNESSES

TECHNICAL FIELD

This invention relates to braided shielding for a wire harness, which braided shielding is flexible and lightweight. More particularly this invention relates to a braided wire harness shield which has an open weave configuration and provides protection against electrical transients resulting from lightning strikes, and provides protection against electromagnetic interference (EMI). The braid exhibits lower (better) surface transfer impedance than conventional braided shielding for frequencies below 50 MHz. Surface transfer is an intrinsic parameter of a shield that corresponds directly to shielding effectiveness and lightning protection capability.

BACKGROUND ART

Wire harnesses which are used in aircraft, ships and in-ground installations are typically encased in a protective shield which is formed from multi-strand carriers which are braided onto the wire harness. The purpose of the shield is to protect the wire harness against lightning strikes and EMI. The conventional approach to providing the aforesaid protection has been to provide maximum area coverage for the wire harness with the braid, typically 85 to 95%. This approach has been taken in part because of the perceived need to provide high frequency (above 50 MHz) EMI shielding for the wire harness. The resultant braid has been conventionally formed with a relatively large angle of strand carrier application onto the wire harness, i.e., typically about 60 degrees.

The weight of the shielding is a significant factor in the overall weight of the wiring components in a facility which requires such shielding. The use of the wire harness braided shielding has increased in recent years due primarily to two considerations, which are:

1) the use of electronic systems to replace mechanical devices, especially in aircraft flight controls; and 2) the use of composite materials which utilize graphite to replace metal structures in aircraft and other craft We have determined that electronic equipment can be protected against high-frequency EMI by filtering the input and output wiring using light weight components, such as pin-filter connectors, and that such filtering is sufficient to protect against frequencies greater than 50 MHz in most applications. Thus, a braided shield providing high frequency protection is unnecessary, and may only add weight and stiffness to the wiring assembly. These weight and stiffness characteristics are not desirable, especially in aircraft applications.

Wire shielding is required to provide low frequency shielding for lighning protection and to preclude interference due to low frequency external electromagnetic fields. The lightning requirement stems from large transient voltages that result when lightning current flows in a resistive structure. The external field requirement arises from the fact that filter components for low frequencies are physically large and therefore impractical for applications where weight is critical, and furthermore, that such filters may interfere with proper functioning of the equipment. Therefore, wire harness shielding is needed to prevent interference from low-frequency sources.

It would be desirable to provide a wire harness shielding braid which is both flexible and light-weight, and yet provides the necessary shielding protection.

DISCLOSURE OF THE INVENTION

This invention relates to a braided electrical shielding for an electrical wire harness, which braided shielding consists of an open braid that provides coverage for less than the entire outer surface of the wire harness, and therefore produces a lighter and more flexible braided shielding. A primary application of this invention is in lightweight lightning protection of electronic equipment installed in moderately conductive structures, such as a graphite aircraft fuselage. The invention can also be used in conjunction with non-aircraft applications which require electromagnetic protection of electronic equipment, whether installed on metallic or non-metallic structures.

The percentage of wire harness coverage provided by the shielding of this invention can be as low as about 60%, and can go as high as about 70% without unduly sacrificing the desired reduction in weight and flexibility. In order to obtain the desired flexibility and weight reduction, the carrier strands of the braid are laid onto the wire harness at a relatively flat angle in the range of about eighteen degrees to about twenty four degrees, and preferably about twenty degrees, relative to the axis of the harness. The aforesaid flat braid carrier angle results in a braid which has between three and eight picks per inch, with a typical number of picks per inch being four.

Present day government specs, as defined in MIL-C-27500, call for a minimum of 85% coverage of the wiring harness by the braid, and call for a braid angle in the range of eighteen to forty degrees. In practice, one cannot achieve a minimum coverage of 85% with a carrier angle in the lower end of the aforesaid range, therefore, the braid carriers are laid onto the wiring harness at angles which are at the higher end of the aforesaid range and even above the forty degree angle, up to about sixty degrees.

The resultant braid will typically have about eighteen picks per inch, and is quite stiff and heavy, and does not improve low frequency performance.

An unexpected result of using the open braid shielding of this invention is that shielding formed in accordance with this invention, as compared with the more dense shielding of the prior art, provides improved transfer impedence, which improvement is a function of the DC resistance of the braid. DC resistance is essentially the parallel combination of all strands in the braid. The lowest resistance is achieved by a maximum number of strands in the shielding, and equally important, minimal strand length in the braid. Minimal strand length can only be obtained by decreasing the angle of laying the braid on the harness. The ability to maintain a braid application angle that will ensure securement of the braid on the wire harness, and which also minimize strand length, so as to decrease shielding weight, is an important advantage to this invention. The necessity of achieving minimal practical coverage while meeting performance requirements in the low frequency range of DC to 50 MHz, without sacrificing adhesion of the shielding to the harness, is accomplished by utilizing a braid which has from three to eight picks per inch (a standard shield braid has eighteen picks per inch). Utilizing a braid with less than about three picks per inch results in negligible weight savings, and therefore is not seen to be particularly desirable, since a main advantage of the invention is to obtain a lessening of wire harness weight.

The light weight braid of this invention does not display degraded performance at higher frequencies. The surface transfer impedance for the lightweight braid of this invention is surprisingly better than the standard heavier braid for frequencies below 50 MHz. The lightweight braid of this invention will reduce lightning-induced voltage transients by at least 25% under all conditions of use.

It is therefore an object of this invention to provide an improved wire harness shielding which is lighter in weight than conventional shielding.

It is another object of this invention to provide a wire harness shielding of the character described which utilizes an open braid which covers less than the entire outer surface of the wire harness.

These and other objects and advantages of the invention will become more readily apparent from the following detailed description of several embodiments of the invention when taken in conjunction with the accompanying drawings in which:

DETAILED DESCRIPTION OF SPECIFIC EMBODIMENTS OF THE INVENTION

Figure 1:
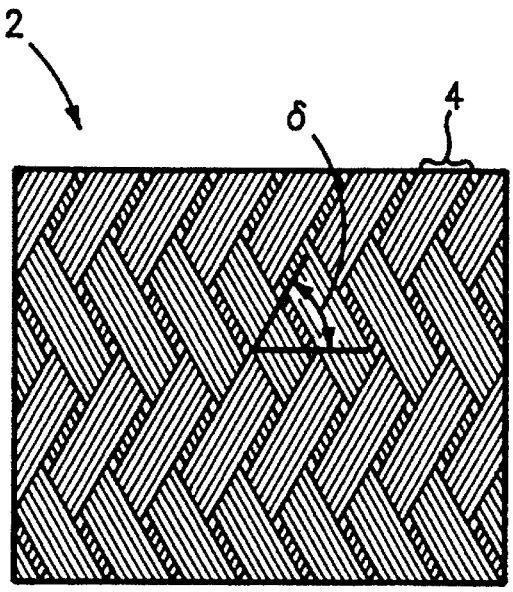
FIG–1 (PRIOR ART)
FIG. 1 is a plan view of a closed braid wire harness shield formed in accordance with the prior art.

Referring now to FIG. 1, there is shown a portion of a braided shield 2 for a wire harness that is formed in accordance with the prior art. The braid employs six stranded carriers 4 that are braided onto the wire harness at an included angle $\partial$ of sixty degrees. The resultant braided shield has eighteen picks per inch and covers essentially the entire outer surface of the underlying wire harness, i.e., typically about 95%. This braided wire harness is heavy, and weighs about 0.048 lb/ft when 0.0063 inch diameter carrier strands are used on a one-half inch diameter wire harness. The large angle of the braid also results in a very stiff wire harness which is difficult to manipulate and fit into tight locations, which will be found in aircraft such as helicopters and the like. The stiffness also results in problems covering wire harnesses which have different diameter portions.

Figure 2:
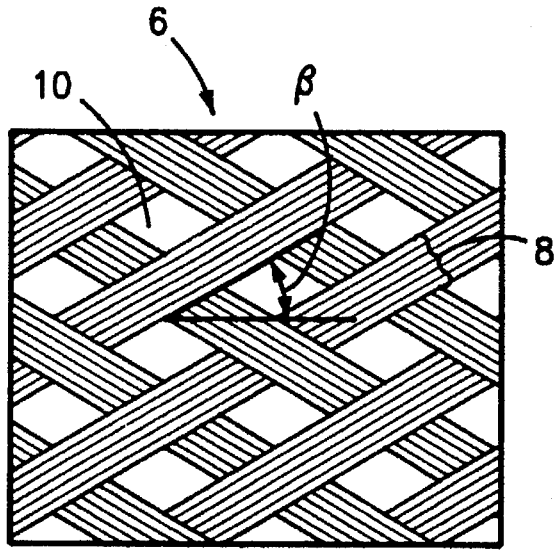
FIG. 2 is a view similar to FIG. 1 but showing an open braid wire harness shield formed in accordance with this invention.

FIG. 2 shows a portion of a braided shield 6 which has been formed in accordance with this invention. The braid 6 employs six stranded carriers 8 which are braided onto the wire harness at an included angle $\beta$ of twenty two degrees. The resultant braided shield has eight picks per inch, and includes a regular pattern of openings 10. The braided shielding 6 covers about 65% of the wire harness, and when 0.0063 inch diameter carrier strands are used, weighs about 0.025 lb/ft when braided onto a one-half inch diameter wire harness. The shielded wire harness is quite flexible and is relatively easy to manipulate into place. A weight saving of more than about 40%, as compared to the prior art braided shielding, is achieved.

It will be readily appreciated that the braiding of this invention will provide substantial weight savings, and will provide the necessary lightning strike and EMI shielding for wire harnesses on which it is braided. The flexibility of the braided wire harness aids in properly placing it in tight locations which are typically found on aircraft and in other applications.

Since many changes and variations of the disclosed embodiment of the invention may be made without departing from the inventive concept, it is not intended to limit the invention otherwise than as required by the appended claims.

What is claimed is:

1. A wiring harness shielding braid which is operative to protect a wiring harness against lightning strikes and electromagnetic interference (EMI), said shielding braid comprising a plurality of braided strand carriers which are operable to cover at least about 60% but no more than about 70% of the wiring harness, said strand carriers being disposed at an included angle in the range of about eighteen degrees to about twenty four degrees relative to an axis of elongation of the wiring harness.

2. The shielding braid of claim 1 wherein said strand carriers are braided so as to provide a braid with about three picks per inch to about eight picks per inch.

3. A wiring harness with a shielding braid which is operative to protect the wiring harness against lightning strikes and electromagnetic interference (EMI), said shielding braid comprising a plurality of braided strand carriers which are operable to cover at least about 60% but no more than about 70% of the wiring harness, said strand carriers being disposed at an included angle in a range of about eighteen degrees to about twenty four degrees relative to an axis of elongation of the wiring harness.

4. The wiring harness of claim 3 wherein said strand carriers are braided so as to provide a braid with about three picks per inch to about eight picks per inch on the wiring harness.

5. A method for forming a wiring harness shielding braid which is operative to protect the wiring harness against lightning strikes and electromagnetic interference (EMI), said method comprising the steps of laying a plurality of strand carriers in an open braid, which braid is operable to cover at least about 60%, but no more than about 70% of the wiring harness, said strand carriers being braided at an included angle in a range of about eighteen degrees to about twenty four degrees relative to an axis of elongation of the wiring harness.

6. The method of claim 5 including the step of forming an open braid having about three to about eight picks per inch.

7. A method for forming a wiring harness shielding braid which is operative to protect the wiring harness against lightning strikes and electromagnetic interference (EMI), said method comprising the steps of laying a plurality of strand carriers in an open braid on the wiring harness, which braid is operable to cover of at least about 60%, but no more than about 70% of the wiring harness, said strand carriers being braided at an included angle in a range of about eighteen degrees to about twenty four degrees relative to an axis of elongation of the wiring harness.

8. The method of claim 7 including the step of forming an open braid having about three to about eight picks per inch.

* * * * *